US009533782B2

(12) United States Patent
Slovik et al.

(10) Patent No.: US 9,533,782 B2
(45) Date of Patent: Jan. 3, 2017

(54) UNIVERSAL CUTOFF SYSTEM FOR CONTAINER CARRIER APPLICATING MACHINE

(75) Inventors: Rachell Slovik, Bartlett, IL (US); Christopher J. Ludwig, Buffalo Grove, IL (US); Christopher J. Samaras, Tinley Park, IL (US); Jonathan Gregersen, Oswego, IL (US)

(73) Assignee: Illinois Tool Works Inc., Glenview, IL (US)

( * ) Notice: Subject to any disclaimer, the term of this patent is extended or adjusted under 35 U.S.C. 154(b) by 536 days.

(21) Appl. No.: 13/485,458

(22) Filed: May 31, 2012

(65) Prior Publication Data

US 2013/0036881 A1 Feb. 14, 2013

Related U.S. Application Data

(60) Provisional application No. 61/522,947, filed on Aug. 12, 2011.

(51) Int. Cl.

| | |
|---|---|
| ***B65B 59/00*** | (2006.01) |
| ***B65B 17/02*** | (2006.01) |
| *B65B 13/04* | (2006.01) |

(52) U.S. Cl.

CPC ..... *B65B 17/025* (2013.01); *B65B 59/00* (2013.01); *B65B 13/04* (2013.01); *Y10T 83/04* (2015.04); *Y10T 83/546* (2015.04)

(58) Field of Classification Search

CPC ..... B65B 13/04
USPC ..... 53/48.1, 55, 64, 48.2, 48.3, 398, 443, 52,53/147; 493/236, 239
See application file for complete search history.

(56) References Cited

U.S. PATENT DOCUMENTS

| | | | | |
|---|---|---|---|---|
| 3,026,594 | A * | 3/1962 | Gajda et al. | 264/148 |
| 3,383,828 | A * | 5/1968 | Cunningham | 53/398 |
| 3,594,045 | A * | 7/1971 | Pannier et al. | 300/21 |
| 4,230,029 | A * | 10/1980 | Schott, Jr. | 493/370 |
| RE30,598 | E * | 5/1981 | Spencer | B26D 1/58 83/14 |
| 5,065,565 | A * | 11/1991 | DiFrank | 53/398 |
| 5,179,770 | A * | 1/1993 | Block | B21D 13/04 156/205 |
| 5,211,711 | A * | 5/1993 | Marco | 83/862 |
| 5,289,747 | A * | 3/1994 | Wunderlich | B26D 3/16 83/313 |
| 5,603,801 | A * | 2/1997 | DeFriese et al. | 156/515 |
| 6,055,791 | A * | 5/2000 | Odum et al. | 53/48.4 |
| 6,141,939 | A * | 11/2000 | Pedrotti et al. | 53/48.1 |
| 7,081,048 | B2 * | 7/2006 | Bech | 452/161 |
| 8,112,970 | B2 * | 2/2012 | Marco et al. | 53/398 |
| 8,387,341 | B2 * | 3/2013 | Moore et al. | 53/48.1 |
| 8,978,531 | B2 * | 3/2015 | Schaferling | B23D 45/046 83/303 |

(Continued)

FOREIGN PATENT DOCUMENTS

EP 1 495 969 A1 6/2004

*Primary Examiner* — Christopher Harmon
(74) *Attorney, Agent, or Firm* — Pauley Erickson & Kottis

(57) ABSTRACT

An applicating machine for applying a flexible carrier to a plurality of containers provided from an infeed includes a jaw drum for applying a flexible carrier to a plurality of containers provided and a cutoff device for cutting the carrier into a desired size. The cutoff device includes an adjustable beam positionable into multiple angular positions relative to a flow of the plurality of containers depending on the desired size of the multipack.

20 Claims, 3 Drawing Sheets

(56) References Cited

U.S. PATENT DOCUMENTS

| | | | | |
|---|---|---|---|---|
| 2004/0003573 | A1* | 1/2004 | Moore | 53/48.1 |
| 2007/0261373 | A1 | 11/2007 | Slovik et al. | |
| 2010/0192512 | A1 | 8/2010 | Moore et al. | |
| 2011/0005169 | A1 | 1/2011 | Ober | |

* cited by examiner

UNIVERSAL CUTOFF SYSTEM FOR CONTAINER CARRIER APPLICATING MACHINE

CROSS REFERENCE TO RELATED APPLICATION

This application claims the benefit of U.S. Provisional Application No. 61/522,947, filed 12 Aug. 2011.

BACKGROUND OF THE INVENTION

Field of the Invention

This invention relates to a universal cutoff system for dividing a flexible container carrier into desired multiples of containers.

Description of Prior Art

Container carriers connect two or more containers into a sturdy unitized package or "multipack" of containers. Carriers are generally planar arrays of rings, sometimes referred to as "six-pack carriers," typically formed from a thermoplastic sheet material. Carriers are applied to containers of various sizes and shapes. A preferable machine would be capable of application of a container carrier to a wide range of container sizes in a number of different package sizes.

Prior art multi-packaging devices and methods generally require several different versions or configurations of machines to accommodate different container carrier, multipack sizes and multipack configurations. Machines are traditionally a limitation on the range of container diameters, size of package or configuration of package that can be effectively packaged by a single system.

In addition, different machines or complex set-up procedures would also be required for different sizes of multipacks, for instance 4-packs, 6-packs and/or 12-packs. Each different multipack size would typically require different machines and/or complex set-up of machine configurations to accommodate division and diversion of differently sized packages.

Finally, different machines or complex set-up procedures would also be required for containers having different diameters. As such, different machines and/or set-up procedures are traditionally required to divide multipacks into desired sizes when a new set of containers having different diameters from earlier applied carriers is packaged. Conventional applicating machines include a jaw drum used to apply carriers to individual containers. Such conventional applicating machines typically include an infeed conveyor for supplying a plurality of containers within a limited range of diameters to the jaw drum. Additionally, a reel stand is positioned upstream of the jaw drum to supply a generally continuous stream of carriers to a feed drum and then on to the jaw drum.

The string of carriers are then traditionally applied to the containers and, following application, cut into a desired package configuration. Traditional cutting methods and equipment required a pin drum with fixed pitch pins positioned prior to the jaw drum to meter the carrier and separate portions of the carrier where required, such as at handle connections. A cutoff starwheel was then positioned after the jaw drum which utilized a cam actuated knife to separate the connections between adjacent packages, or "multipacks." The resulting multipack is then fed into a turner-diverter that moves and/or rotates the package to a correct position for placement on a pallet or similar shipping unit.

Accordingly, an entirely distinct applicating machine is typically required when packaging a second plurality of containers outside of a size range that can be accommodated with the standard applicating machine. Specifically, for the cutting methods and equipment, for containers having different diameters and/or multipacks of different sizes, existing equipment typically required changing the pin drum pitch for each jaw drum pitch to be run as well as the pitch and centerline spacing of the cutoff starwheels.

SUMMARY OF THE INVENTION

It is one object of this invention to provide a machine that combines speed, flexibility, quick changeover and ease of operation and maintenance.

It is another object of this invention to provide a machine for unitizing a plurality of containers having a range of possible container sizes and diameters and/or for dividing multipacks into a range of possible numbers of containers, i.e., 4 packs, 6 packs, 8 packs.

According to one preferred embodiment of this invention, a cutoff device for cutting a generally continuous string of container carriers and containers into individual multipacks includes an adjustable beam having a timing belt and a plurality of knives positioned around the timing belt at suitable increments based upon a desired size of the package.

The adjustable beam is preferably positionable between a first angular position relative to a flow of the generally continuous string of container carriers and a second angular position relative to the flow of the generally continuous string of container carriers. More specifically, a beam angle may be altered to set the blades at an appropriate pitch to match a length of the desired multipack for a given container diameter. In this manner, a variety of multipack sizes and/or container diameters may be divided following adjustments to the cutoff device.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
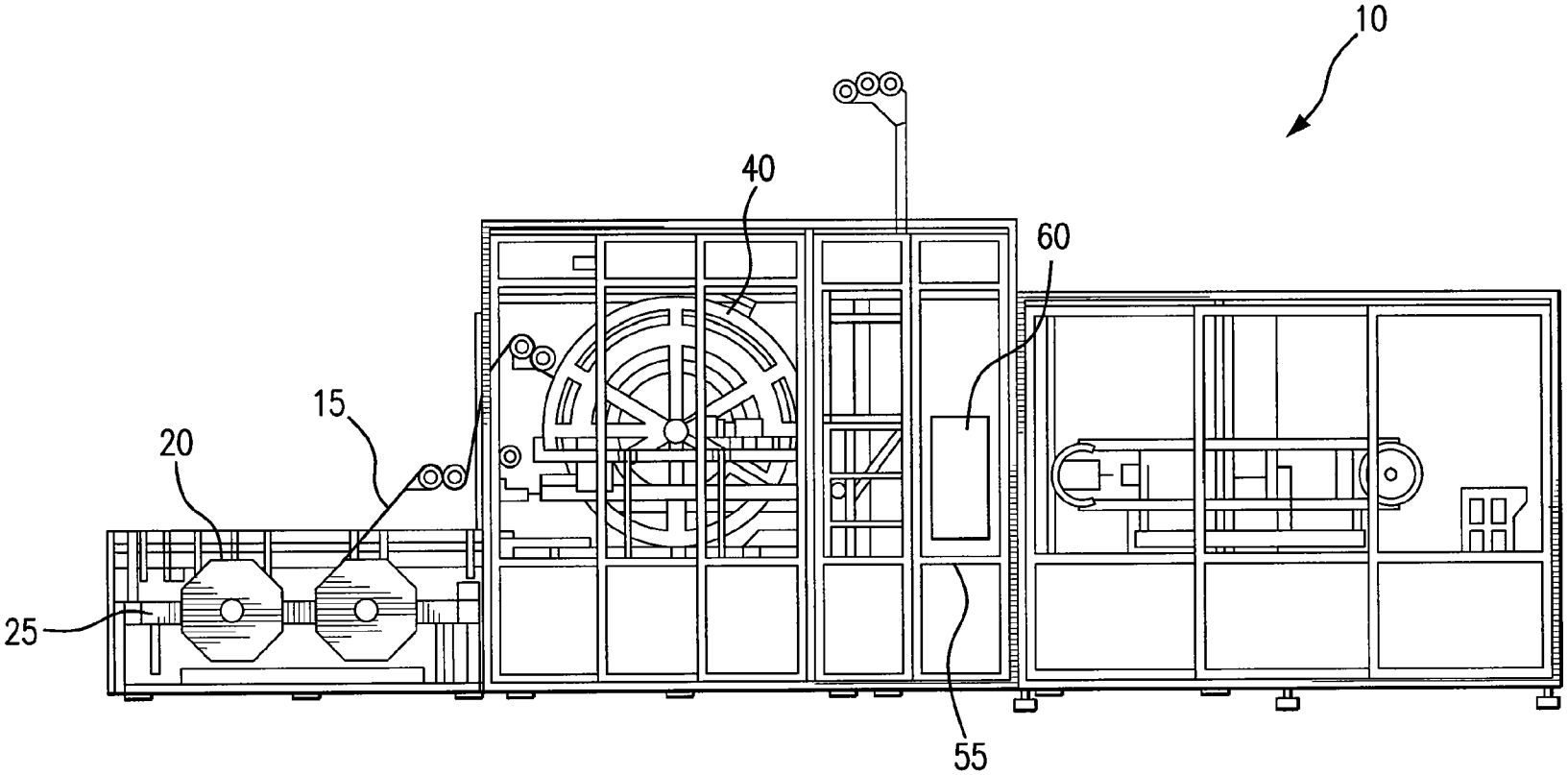
FIG. 1 is a side view of a machine according to one preferred embodiment of this invention.
Figure 2:
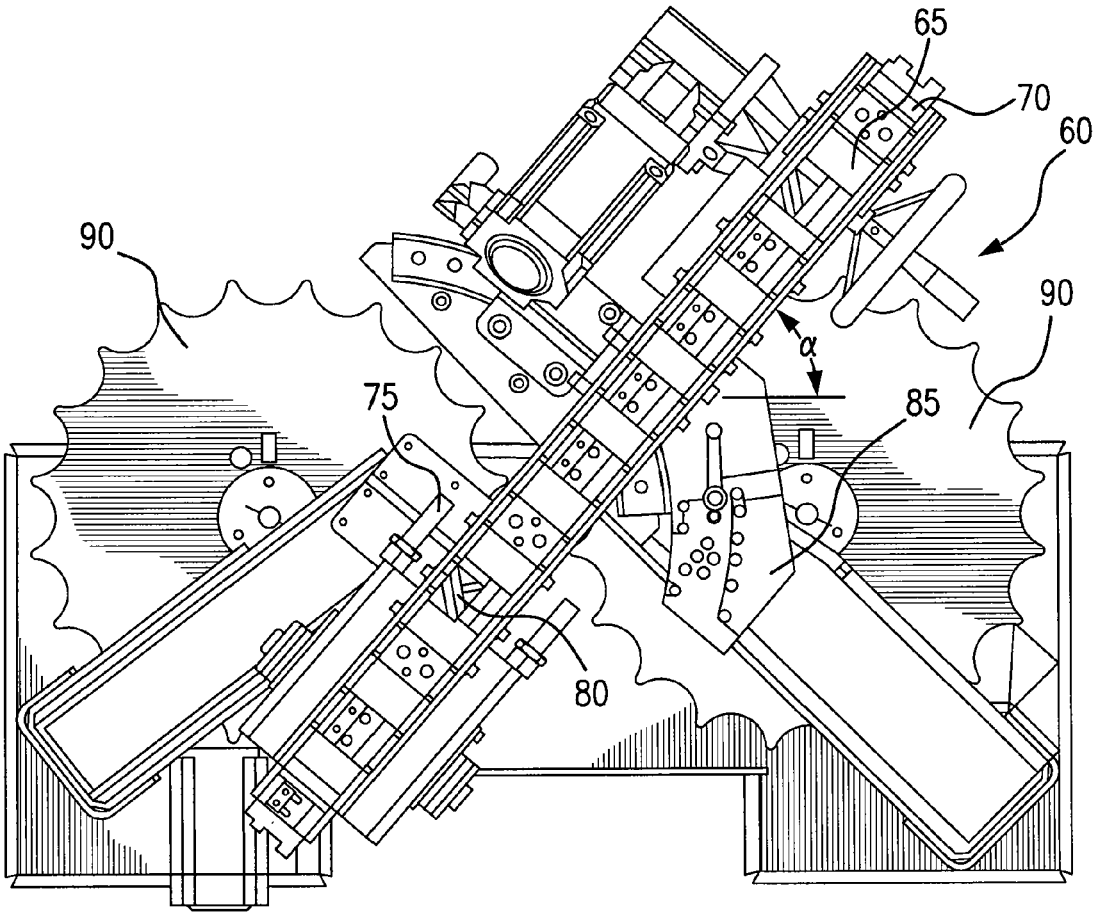
FIG. 2 is a top view of a cutoff device according to one preferred embodiment of this invention machine.
Figure 3:
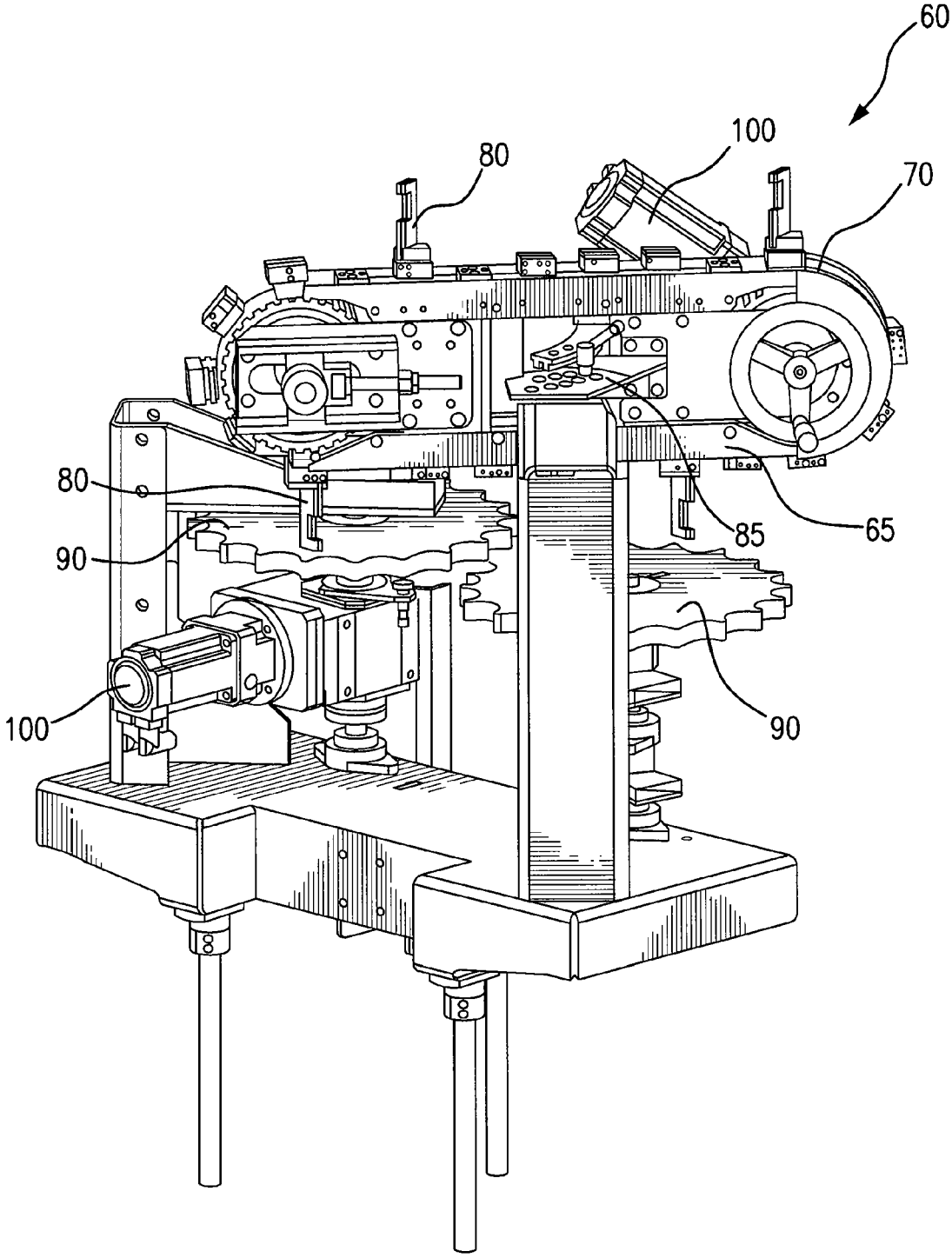
FIG. 3 is perspective side view of the cutoff device shown in FIG. 2.

FIGS. 1-3 show an applicating machine and a cutoff device for packaging multiple containers in a carrier according to one preferred embodiment of this invention. As shown in FIG. 1, carrier stock 15 moves through machine 10, specifically through jaw drum 40, where it is applied to containers and then separated into individual, unitized packages with cutoff device 60. According to one preferred embodiment of this invention, if a uniform group of like-sized containers having a different size requires packaging and/or if a package is required having a different configuration and/or if a different carrier is required, a separate machine is unnecessary as machine 10, and particularly cutoff device 60, may be quickly reconfigured, following various adjustments to machine 10, as described below.

Therefore, the machine 10 for packaging multiple containers in multiple size packages according to this invention permits the use of a single machine in combination with a variety of sizes of containers, sizes of packages and configurations of packages. Traditional machines are typically fifteen or more feet long and six or more feet wide, therefore a reduction in the number of machines required in a packaging plant significantly reduces the required working floor space within the plant. In addition, quick and generally toolless set-up and changeover results in more efficient packaging operations.

Carrier stock 15 preferably moves through machine 10 from reel stand 25 where carriers are dispersed in a continuous string of carrier stock 15 from either reels or large boxes of carrier stock and ultimately to packages where each carrier is separated into a unitized package, each package containing a plurality of uniform containers. A typical configuration for a package is a "six-pack" containing two longitudinal rows of containers in three transverse ranks. Additional desired packages such as four-packs, eight packs and twelve packs may be unitized using machine 10 according to this invention, and such additional sizes of packages are limited only by the consumer market for such additional sizes.

Carrier (and carrier stock) is preferably constructed from a flexible plastic sheet, such as low-density polyethylene. The flexible plastic sheet is punched or otherwise formed into a plurality of container receiving apertures aligned in transverse ranks and at least two longitudinal rows to form a continuous sheet of carriers.

Infeed conveyor 20 may extend generally through reel stand 25 to provide a generally continuous supply of containers to machine 10 and specifically jaw drum 40. Infeed conveyor 20 is preferably positioned to convey containers longitudinally into a platform of machine 10, in preferably two longitudinal rows.

According to one preferred embodiment of this invention, machine 10 for packaging multiple containers includes moving a generally continuous supply of carrier stock 15 through machine 10 from reel stand 25. Carrier stock 15 then enters machine 10 into jaw drum 40. Following application to containers, carrier stock 15 is divided into individual carriers using cut-off device 60 resulting in individually unitized packages of a desired size which are then dispersed to a case packer (not shown), for example, by using a turner/diverter.

According to a preferred embodiment of this invention, a plurality of containers each having a different diameter may also be packaged using the same machine 10. According to a preferred embodiment of this invention, when a changeover is desired, the cutoff device 60 may be manipulated as described in more detail below.

In this manner, an operator can use a single machine to package a wide range of containers in a wide range of multipack sizes. Specifically, it is desirable that machine 10 is capable of packaging containers within a diameter range of approximately 2 inches to approximately 3 inches, more specifically between approximately 2.3 inches and approximately 2.9 inches. According to a preferred embodiment of this invention, machine 10 is capable of packaging up to 2400 containers per minute.

Although cutoff device 60 is specifically described herein, one or more additional operative components of machine 10 may be adjustable to permit packaging of containers having different sizes, such as heights and diameters, carriers having different sizes, packages having different sizes, such as six-packs and twelve-packs, and packages having different configurations, namely rim-applied carrier (RAC) configurations and side-applied carrier (SAC) configurations. In each of these different applications, multiple components of machine 10 may be adjusted, replaced and/or interchanged to permit application of carrier stock to containers.

Accordingly, a plurality of containers is provided from infeed conveyor 20 to jaw drum 40 for application of carrier stock 15 to containers. As described, jaw drum 40 may be positioned with respect to infeed conveyor 20 to accept the plurality of containers. Carrier stock 15 proceeds from reel stand and/or infeed to jaw drum 40, particularly to a plurality of jaw pairs located radially about jaw drum 40. Jaw drum 40 preferably comprises a cylindrical member rotatable about a horizontal axis which transports carrier stock 15 to the plurality of containers which flow through jaw drum 40. As the jaw pairs move with the rotation of jaw drum 40, container receiving apertures within carrier stock 15 stretch to accommodate a container. Carrier stock 15 in a stretched condition is positioned over a plurality of containers so that each container receiving aperture engages with one container. Upon engagement with the containers, carrier stock 15 is released from the respective jaw pair and grips a perimeter of container.

Output conveyor 55 preferably conveys the containers longitudinally from jaw drum 40 after carrier stock 15 has been applied. After carrier stock 15 is stripped from jaw drum 40, a continuous string of unitized containers proceeds along output conveyor 55 and through cutoff device, such as shown in FIGS. 2 and 3. According to a preferred embodiment of this invention, cutoff device 60 is adjustable and/or replaceable with minimal use of tools to divide packages into any number of desired sizes.

According to a preferred embodiment, cutoff device 60 for cutting a generally continuous string of container carriers 15 and containers into individual multipacks includes adjustable beam 65 having timing belt 70 and a plurality of knives 80 positioned around timing belt 70 at suitable increments based upon a desired size of the package. As best shown in FIG. 3, adjustable beam 65 is preferably positioned above the flow of the containers.

Adjustable beam 65 is preferably positionable between a first angular position relative to a flow of the generally continuous string of container carriers and a second angular position relative to the flow of the generally continuous string of container carriers. In practice, adjustable beam 65 may be positioned in any number of angular positions depending on the number of multipack configurations that are desired. More specifically, a beam angle a may be altered to set blades 80 at an appropriate pitch to match a length of the desired multipack for a given container diameter. A central, vertically extending shaft 75 is preferably positioned within cutoff device 60 about which adjustable beam 65 pivots.

A control panel 85 having two or more discrete hard stops for the angular adjustment of adjustable beam 65 may be connected with respect to cutoff device 60 and may be labeled with a corresponding desired multipack size or configuration, such as four pack or six pack.

In addition, a plurality of blades 80 are preferably positioned along timing belt 70 in an adjustably positionable manner. As a result of the adjustability of adjustable beam 65 angle and/or blades 80, cutoff device 60 is adjustable to accommodate a range of multipack sizes and container sizes. Specifically, as described, adjustable beam 65 angle may be adjusted as individual container size is changed and blades 80 may be repositioned as the multipack size is changed. For instance, if a six-pack is desired, adjustable beam 65 and/or a position of blades 80 may be adjusted so that in between every three containers to cut carrier stock 15 into packages having three ranks of two rows of containers. Likewise, if an eight-pack is required, adjustable beam 65 and/or a position of blades 80 are positioned in between every four containers to cut carrier stock 15 into packages having four ranks of two rows of containers.

Further, at least one, and preferably two interchangeable star wheels 90 are positioned relative to the timing belt 70, where the at least one interchangeable star wheel 90 engages the containers as they flow through applicating machine 10. The pair of interchangeable star wheels 90 are preferably complementary and sized according to a diameter of each container and may be substituted for replacement when a new series of larger or smaller diameter containers are desired for packaging. Star wheels 90 are preferably powered to move containers through cutoff device 60 at a desired pace.

Blades are preferably removable and/or adjustable within timing belt 70 preferably using methods that provide quick and efficient removability and replaceability. For instance, a plurality of chucks may be positioned around timing belt 70 and each blade 80 may be positioned within a chuck depending on the desired location.

Accordingly, adjustable beam 65 and the star wheels 90 are preferably configured to accommodate containers having diameters between approximately 2 inches and approximately 3 inches.

A desired method of operation of cutoff device 60 according to this invention enables cutting a generally continuous string of container carrier 15 and containers into individual multipacks by adjusting an angular position of adjustable beam 65 depending on at least one of a size of the multipack and a size of the containers and cutting the generally continuous string of container carrier into individual multipacks having a desired size, depending on where blades 80 on adjustable beam 65 engage with carrier stock 15.

According to one preferred embodiment of this invention, one or more of the operative components of machine 10 preferably includes an associated drive, either electrical or mechanical. The associated drive may include a servo 100 providing power and feedback or a simple motor providing only power. According to one preferred embodiment of this invention, a drive electrically connects one component of machine 10 with respect to at least one other component of machine 10 including jaw drum 40 and cutoff device 60, specifically timing belt 70 and/or star wheel 90. More specifically, servo 100 may be used for adjusting the relative speed of star wheel 90 and timing belt 70 depending on at least one of a size of the multipack and a size of the containers.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. A cutoff device for cutting a generally continuous string of container carriers and containers into individual multipacks, the device comprising:

an adjustable beam including a timing belt, the adjustable beam positionable between a first angular position relative to a flow of the generally continuous string of container carriers and a second angular position relative to the flow of the generally continuous string of container carriers;

a plurality of blades positioned along the timing belt and traversing along an angular direction relative to the flow of the generally continuous string of container carriers wherein each successive blade of the plurality of blades cuts completely through between successive container carriers to form individual multipacks;

at least one interchangeable star wheel positioned relative to the timing belt, the at least one interchangeable star wheel engaging the containers.

2. The cutoff device of claim 1 wherein the adjustable beam is positionable in the first angular position to cut the generally continuous string of flexible carrier into a plurality of first multipacks and the second angular position to cut the generally continuous string of flexible carrier into a plurality of second multipacks.

3. The cutoff device of claim 1 further comprising a pair of interchangeable and complementary star wheels.

4. The cutoff device of claim 3 wherein the pair of interchangeable star wheels are sized according to a diameter of each container of the plurality of containers.

5. The cutoff device of claim 1 wherein the adjustable beam and the at least one interchangeable star wheel may be configured to accommodate containers having diameters between approximately 2 inches and approximately 3 inches.

6. The cutoff device of claim 1 wherein the adjustable beam is positioned above the flow of the containers.

7. The cutoff device of claim 1 wherein the plurality of blades are repositionable along the timing belt.

8. The cutoff device of claim 1 further comprising a servo for adjusting the relative speed of the starwheel and the timing belt depending on at least one of a size of the multipack and a size of the containers.

9. The cutoff device of claim 1 further comprising a central, vertically extending shaft about which the adjustable beam pivots.

10. An applicating machine for applying a flexible carrier to a plurality of containers provided from an infeed, the applicating machine comprising:

a jaw drum positioned with respect to the infeed to accept the plurality of containers, the jaw drum applying the flexible carrier to the plurality of containers in a generally continuous string;

a cutoff device positioned downstream of the jaw drum, the cutoff device including an adjustable beam and a plurality of blades, the adjustable beam positionable into multiple angular positions relative to a flow of the plurality of containers, wherein each successive blade of the plurality of blades traverses along an angular direction relative to the flow of the generally continuous string of container carriers and cuts completely through between successive container carriers to form individual multipacks.

11. The applicating machine of claim 10 wherein the adjustable beam is positionable in a first angular position to cut the generally continuous string of flexible carrier into a plurality of first multipacks and a second angular position to cut the generally continuous string of flexible carrier into a plurality of second multipacks.

12. The applicating machine of claim 10 wherein the cutoff system further includes a pair of interchangeable star wheels.

13. The applicating machine of claim 12 wherein the pair of interchangeable star wheels are sized according to a diameter of each container of the plurality of containers.

14. The applicating machine of claim 10 further comprising a timing belt extending along the adjustable beam, wherein the plurality of blades are repositionable along the timing belt.

15. The applicating machine of claim 10 further comprising a servo for adjusting the relative speed of the jaw drum, the starwheel and the timing belt depending on at least one of a size of the multipack and a size of the containers.

16. The applicating machine of claim 10 further comprising a central, vertically extending Shaft about which the adjustable beam pivots.

17. A method for cutting a generally continuous string of container carrier and containers into individual multipacks, the method comprising:

providing a generally continuous string of container carrier and containers to a cutoff device;

adjusting an angular position of an adjustable beam depending on at least one of a size of the multipack and a site of the containers, the adjustable beam including a timing belt;

conveying a plurality of blades along the timing belt traversing along an angular direction relative to the flow of the generally continuous string of container carriers; and cutting the generally continuous string of container carrier into individual multipacks having a desired size wherein each successive blade of the plurality of blades cuts completely through between successive container carriers to form individual multipacks.

18. The method of claim 17 further comprising:

spacing the plurality of blades along the timing belt depending on the desired size.

19. The method or claim 17 further comprising:

positioning the adjustable beam between a first angular position relative to a flow of the generally continuous string of container carriers and a second angular position relative to the flow of the generally continuous string of container carriers based upon the desired size.

20. The method of claim 17 further comprising:

moving the generally continuous string of container carrier and containers through the cutoff device with a pair of replaceable star wheels.

* * * * *